United States Patent [19]

Blake

[11] Patent Number: 4,911,336

[45] Date of Patent: Mar. 27, 1990

[54] VALVE WITH INTERCHANGEABLE COMPONENTS

[76] Inventor: William S. Blake, 14 Georgetown Ct., Linwood, N.J. 08221

[21] Appl. No.: 248,416

[22] Filed: Sep. 23, 1988

[51] Int. Cl.[4] ..... B05B 9/043

[52] U.S. Cl. ..... 222/321; 222/385; 239/333

[58] Field of Search ..... 222/321, 383, 384, 385; 239/333

[56] References Cited

U.S. PATENT DOCUMENTS

| | | | |
|---|---|---|---|
| 3,753,518 | 8/1973 | Kutik | 222/383 |
| 4,138,039 | 2/1979 | Micallef | 222/321 |
| 4,173,297 | 11/1979 | Petterson | 222/385 X |
| 4,243,159 | 1/1981 | Spatz | 222/321 X |
| 4,732,549 | 3/1988 | von Schuckmann | 222/321 X |
| 4,757,922 | 7/1988 | Landecker | 222/321 X |

*Primary Examiner*—Joseph J. Rolla
*Assistant Examiner*—Kenneth DeRosa
*Attorney, Agent, or Firm*—Dennis H. Lambert

[57] ABSTRACT

A valve in which standardized, interchangeable components are used for converting the valve to use either in a manually operated pump or an aerosol valve. A poppet member is reciprocable in a valve chamber between a flexible valve housing and a main cylinder housing. By making minor modifications to the poppet member and cylinder housing the valve can be adapted or converted to use either in a manually operated pump dispenser or an aerosol dispenser. Unique valve retaining means for attaching a valve to a container is also disclosed. In one form, snap detents secure together peripheral flanges of the valve housing and cylinder housing and also secure the housings to the container neck. In another form, interfitting structure on the flanges align the housings relative to one another, and a gasket is interposed between the flanges so as to seal the flanges relative to one another and relative to the container neck, with a retaining ferrule engaging and securing the flanges to the container neck.

20 Claims, 4 Drawing Sheets

FIG. 11
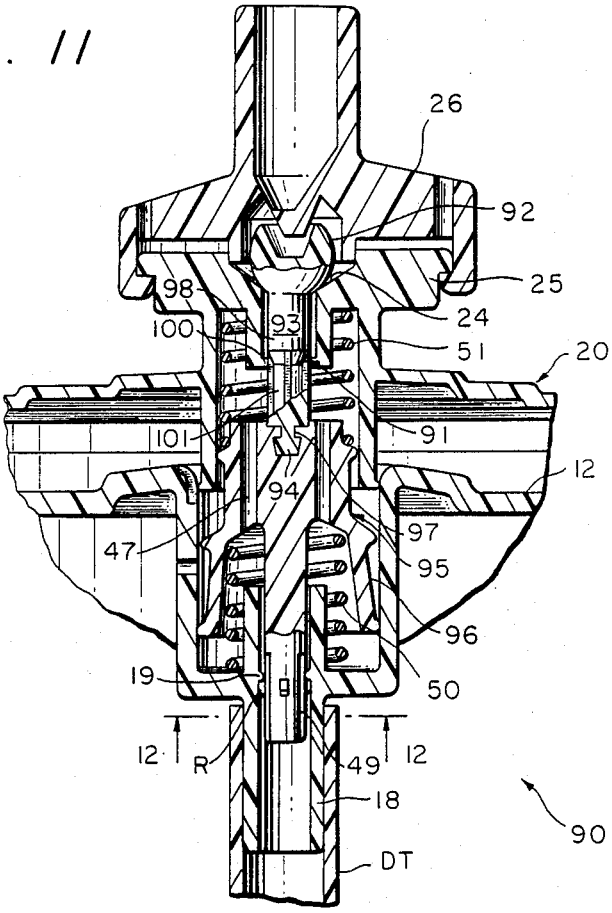
FIG. 12
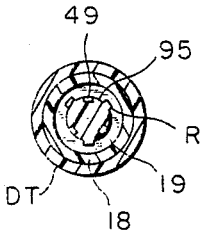
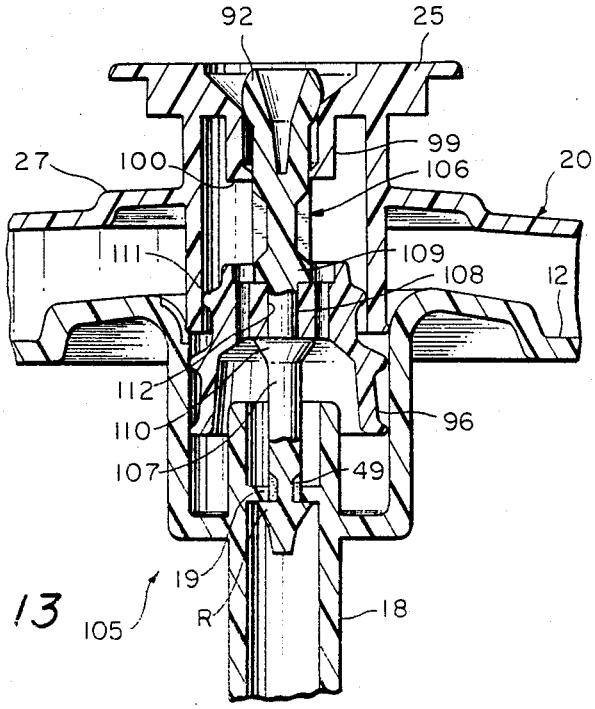
FIG. 13

VALVE WITH INTERCHANGEABLE COMPONENTS

FIELD OF THE INVENTION

This invention relates to valves, and more particularly, to an aerosol valve or pump especially useful for dispensing consumer products.

PRIOR ART

Various means are utilized in the prior art for dispensing consumer products, ranging from pumps and trigger actuated sprayers to pressurized aerosol devices. In each instance, special valve constructions are used for controlling flow of product from the respective containers, depending upon the type of dispensing used.

Conventional aerosol valves usually employ a diaphragm seal gasket to effect a static seal when the valve is not being actuated and a sliding or flexing seal during valve actuation. In structures incorporating axial stem travel, the diaphragm seal gasket should be clamped so that it does not move with the stem, and the system to mounting cup clearance must be minimized to prevent excessive radial interference between the stem and diaphragm seal gasket. Further, the diameter of the center opening in the diaphragm seal gasket must be carefully designed to maintain a sliding seal with the stem and move across the stem orifice outer opening. Most such conventional structures utilize a side port opening on the stem land where the diaphragm seal gasket and stem land interface seal occurs, requiring careful molding techniques and selection of materials to reduce the likelihood of swelling. Tolerances must also be carefully maintained to insure accuracy in valve performance.

Conventional aerosols also typically incorporate springs to return the diaphragm and/or stem to a seated position, and must rely upon gaskets to effect a seal between the valve components and the container. Moreover, on some current aerosol structures, a clean room environment is required for assembly and filling.

Further, the use of metal ferrules to secure the valve components to a metal can often results in displacement of metal shavings from the can, which may contaminate the product being dispensed. The use of aluminum ferrules can lead to oxidation of the metal, with consequent rouging and potential contamination of the product being dispensed.

Other problems may also exist with conventional aerosol valve structures, such as crimping or dishing of the diaphragm seal gasket, leading top potential leakage or inoperativeness of the valve.

Pumps and trigger actuated dispensers require special valving, with springs to assist in returning the valve parts to their at-rest position, and seals to prevent leakage of product. Venting of such structures often presents problems, and difficulty of assembly increases the cot of these prior art devices in many instances. Another factor which can lead to increased costs in such valves is the necessity to manufacture and inventory distinctly different valve components for each type of valve, with the commensurate requirement for different assembly equipment and procedures for each valve.

Efforts have been made in the art to eliminate or reduce some or all of the above problems. For instance, some valves have been made from plastic and designed so as to eliminate the use of separate springs, or metal ferrules, and the like. Other designs have eliminated the side port valving action which is subject to being rendered inoperative because of misalignment of parts, swelling, etc.

Examples of several prior art designs are shown in the following U.S. Pat. Nos.: 2,744,665, 2,835,418, 3,123,261, 3,144,179, 3,372,844, 3,401,84, 3,580,431, 3,613,728, 3,669,316, 3,856,263, 3,862,741, 4,541,552 and 4,570,826. The valves disclosed in these patents variously utilize all-plastic construction, eliminate separate springs and side port valving, and/or use other means to avoid one or more of the problems enumerated above, or to solve other problems and achieve objects not specifically mentioned above. However, the valves disclosed in these patents either fail to provide superior performance and/or reliability, or are relatively expensive and difficult to produce, or still retain one or more of the problems mentioned earlier.

SUMMARY OF THE INVENTION

Accordingly, it is an object of this invention to provide a valve which is simple and economical in construction.

Another object of the invention is to provide a valve which has a minimum number of parts and which is easy to assemble.

A further object of the invention is to provide a valve which incorporates integrated sealing means therein, thereby eliminating the necessity of separate sealing gaskets.

Yet another object of the invention is to provide a valve having interchangeable parts for adapting the valve to use with pumps or aerosol valves.

A still further object of the invention is to provide a valve having components interchangeable between aerosol valves and pumps to reduce manufacturing, inventory and assembly costs.

Another object of the invention is to provide a valve in which the use of separate springs may be eliminated.

Yet another object of the invention is to provide an aerosol valve in which all components of the valve are produced from synthetic plastic materials, and the use of rubber is eliminated.

An even further object of the invention is to provide an aerosol valve comprised of plastic components which may be sonically welded together, including the use of PET for both the valve and container on which the valve is mounted.

Another object of the invention is to provide a valve having a minimum number of parts and which may be adapted for use on different style containers, such as glass, metal or plastic bottles or cans.

A further object of the invention is to provide a valve having an interchangeable stem so that stems of different size may be easily substituted for use with different actuators.

In accordance with the invention, an aerosol valve and pump are manufactured from plastic materials and each includes a reciprocable poppet member mounted for movement in a chamber defined between a resilient valve housing and seat member and a main cylinder housing and poppet retainer. The seat member and retainer are adapted to be secured to a container by any suitable means. For instance, if the valve is to be secured to a plastic bottle, the cylinder housing may be sonically welded to the neck ring of the container. Similarly, the valve housing and seat member may be sonically welded to the cylinder housing, and a stem member may be sonically welded to the valve housing and seat member to complete the assembly.

Alternatively, the entire valve assembly, including the seat member, retainer and stem may be snapped together, and the assembly snapped to the container. In one form of the invention, the poppet member is of one-piece construction and is assembled by inserting the head of the poppet through the valve seat. In another form, the poppet is of two-piece construction and the head is snap-fitted to the tail piece form opposite sides of the seat.

By making relatively minor modifications to the poppet and the retainer, the valve may be adapted for use with either a pump type dispenser, or an aerosol type pressurized dispenser.

The valve constructions have a minimum number of parts, and may be produced from plastic materials, including recycled PET. At the same time, the valve exhibits superior performance, requiring less closing force than prior art constructions and is less susceptible to variations in manufacturing tolerance, assembly forces, etc., than are prior art devices.

Brief Description of the Drawings

The foregoing and other objects and advantages of the invention will become apparent from the following detailed description and accompanying drawings, in which like reference characters designate like parts throughout the several views, and wherein:

FIG. 11 is a fragmentary vertical sectional view of a modification of the invention shown in FIG. 1;

FIG. 12 is an enlarged sectional view taken along line 12—12 in FIG. 11;

FIG. 13 is a fragmentary vertical sectional view of a second modification of the invention;

DETAILED DESCRIPTION OF THE PREFERRED EMBODIMENTS

Figure 1:
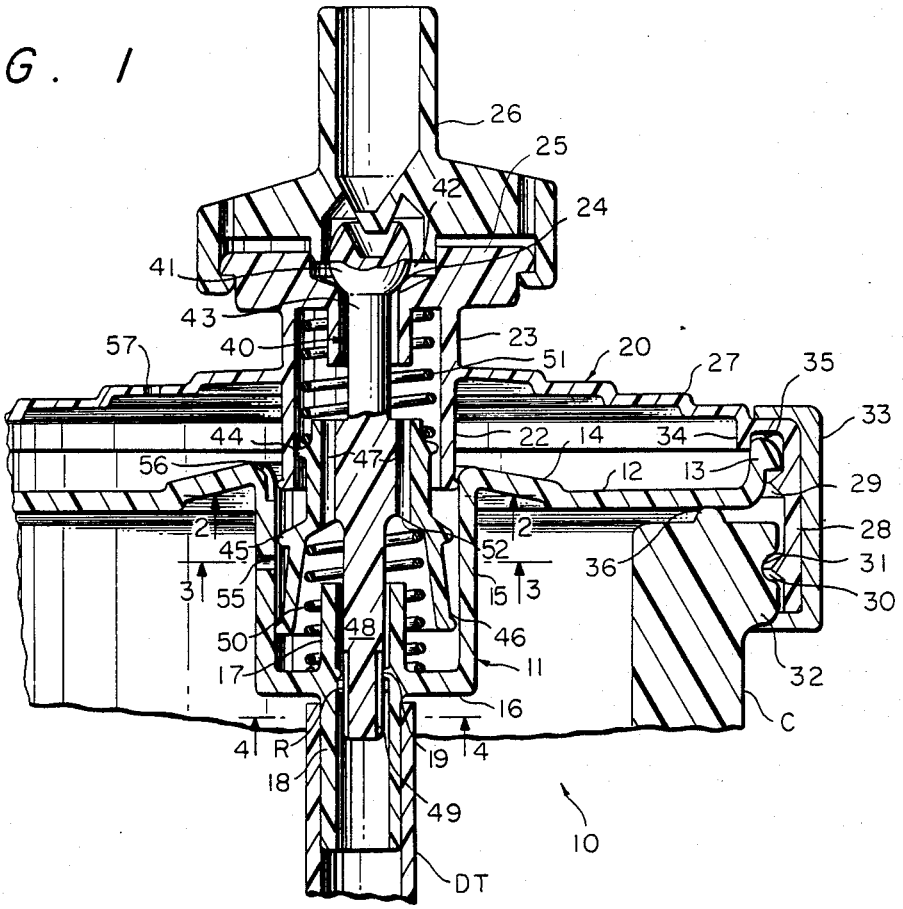
FIG. 1 is an enlarged, fragmentary vertical sectional view of a first form of pump dispenser valve according to the invention.
Figure 2:
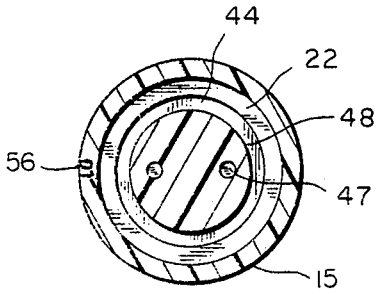
FIG. 2 is a transverse sectional view taken along line 2—2 in FIG. 1.
Figure 3:
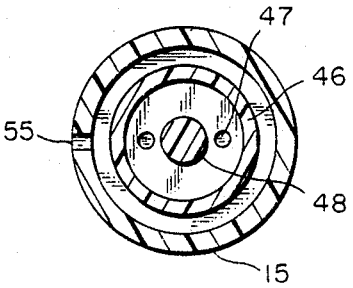
FIG. 3 is a transverse sectional view taken along line 3—3 in FIG. 1.
Figure 4:
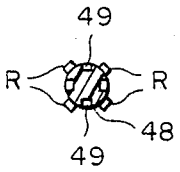
FIG. 4 is a sectional view taken along line 4—4 in FIG. 1.

Referring more particularly to the drawings, a pump dispenser valve in accordance with the invention is indicated generally at 10 in FIGS. 1–4. The valve 10 comprises a main cylinder housing and poppet retainer 11 having a flat, annular end wall portion 12 terminating at its outer edge in a peripheral, upstanding locking flange 13. The inner edge of the wall 12 includes a raised portion 14 surrounding a depending cylindrical pump chamber 15. The pump chamber terminates at a bottom wall 16 having an upstanding, cylindrical guide well 17 formed centrally therein, and a depending cylindrical extension 18. An annular sealing bead 19 is formed on the inner diameter of the guide well 17 at approximately the level of the bottom wall 16 of the pump chamber.

A flexible valve housing and seat member 20 includes a depending cylindrical wall 22 which is slidably received in the pump chamber 15, and an upstanding cylindrical wall 23 having a valve seat 24 formed at the upper end thereof. An outwardly extending stem mounting flange 25 is formed at the upper end of the wall 23, in substantial alignment with the seat 24, for attachment of a stem 26. As shown, the stem may be snap-fitted to the flange 25.

A downwardly and outwardly stepped diaphragm or bellows-like member 27 extends outwardly from the cylindrical wall 22 in overlying, spaced relationship to the end wall 12 of the main cylinder housing, and terminates at its outer periphery in a depending cylindrical wall or skirt 28. The skirt has a first annular locking bead 29 formed therein for snap-fitting engagement with the locking flange 13 on the main cylinder housing, and a second annular locking bead 30 for snap-fitting engagement with a groove 31 formed in the neck 32 of a container C.

A crimped metal ferrule defines a retaining ring 33 of shallow, channel-shaped cross-section fitted over the outer surface of the skirt 28 to assist in retaining the parts in their assembled relationship as shown in FIG. 1. The ferrule is applied axially downwardly over the skirt 28 and the bottom edge then upset to retain the parts as shown in FIG. 1. A short, depending cylindrical wall or flange 34 is formed on the underside of the diaphragm 27, spaced radially inwardly from the skirt 28, defining a pocket 35 in which the locking flange 13 is received when the parts are assembled as shown in FIG. 1, and an upstanding sealing rib 36 on the end wall of the container neck 32 assures a fluid-tight seal between the valve assembly and the container.

A poppet valve and pump piston member 40 has a valve head 41 reciprocable toward and away from the valve seat 24 in a valve chamber 42 defined between the stem 26 and flexible valve housing and seat member 20. An elongate shaft 43 extends downwardly from the head, through the area bounded by the valve seat, and has a radially outwardly enlarged sealing shoulder 44 thereon for sliding engagement in the depending wall 22. A second, further radially enlarged vent sealing shoulder 45 is spaced below the sealing shoulder 44 for sliding engagement in the cylindrical wall of pump chamber 15. Seal 45 prevents leakage of product from the container and through the vent openings.

A slightly outwardly flared piston skirt 46 extends below the shoulder 45 for sliding engagement in the pump chamber, and openings 47 extend through the pump member from beneath the skirt to above the sealing shoulder 44 to establish communication from the pump chamber to the metering chamber.

A tail piece 48 projects downwardly beyond the piston skirt 46 and extends slidably through the sealing bead 19. One or more grooves 49 are formed in a lower end portion of the tail piece for establishing communication between the container and the pump chamber when the grooves are in registry with the sealing bead. The length of th grooves 49 are designed to achieve a timed shutoff of flow of product from the pump chamber back through the housing extension and dip tube and into the container when the stem and thus the poppet valve and piston member are actuated to move downwardly, thereby establishing a predetermined volume of product which is dispensed in each cycle of the pump. Moreover, detents or retainers R are formed on the tail piece for cooperation with the bead 19 to retain the poppet in place and prevent its upward movement out of registry with the opening defined by bead 19.

A coil spring 50 may be engaged between the pump chamber bottom wall 16 and the underside of the poppet piston member to urge the poppet upwardly in a direction to enlarge the volume of the pump chamber, thereby drawing product from the container, through the dip tube DT and grooves 49 and into the piston chamber. Alternatively, the memory of the diaphragm may be relied upon to restore the poppet to its at-rest position shown in FIG. 1. In other words, upon removal of actuating force from the stem, the diaphragm will move upwardly, engaging the seat with the head of the poppet and pulling the poppet upwardly.

A second coil spring 51 is engaged between the shoulder defined by bead 44 on the poppet and the top of the flexible housing 20 to urge the poppet downwardly to the position shown in FIG. 1. This spring exerts a preload on the poppet, making it a non-throttling valve. In other words, the poppet closes on its seat when the pressure is below a predetermined value, thereby preventing "dribbling" of product during a dispensing cycle. Elimination of the spring 51 and its function would, of course, make the valve a throttling type valve.

Downward movement of the poppet is limited by engagement of the underside 52 of the poppet body with the upper end of the guide well 17, or alternatively, by stacking of the return spring, or engagement of other parts of the poppet with other parts of the valve assembly, as desired.

A vent opening 55 is formed through the wall of the piston chamber at a location spaced above the area of sealing contact by the piston skirt for admitting atmospheric pressure to the interior of the container to replace the volume of product dispensed. Atmospheric pressure is communicated to the vent opening via a slot 56 formed in the shoulder at the juncture of the raised portion 14 with pump chamber 15, and an opening 57 formed through the diaphragm 27.

Figure 5:
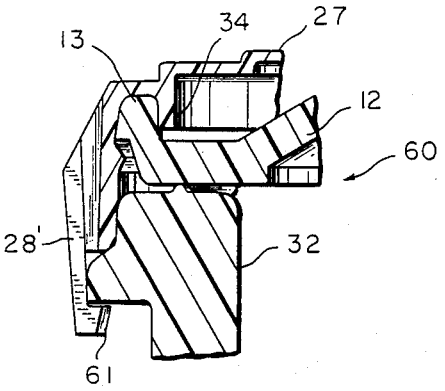
FIGS. 5–10 are fragmentary sectional views of various arrangements for attaching the valve assembly to a container.

A first variation in the mechanical seal for attaching the valve assembly to a container is indicated at 60 in FIG. 5. In this form of the invention, the depending skirt 28' is modified to include reinforced snap detents 61 and the retaining ring 33 of the first form of the invention is eliminated.

Figure 6:
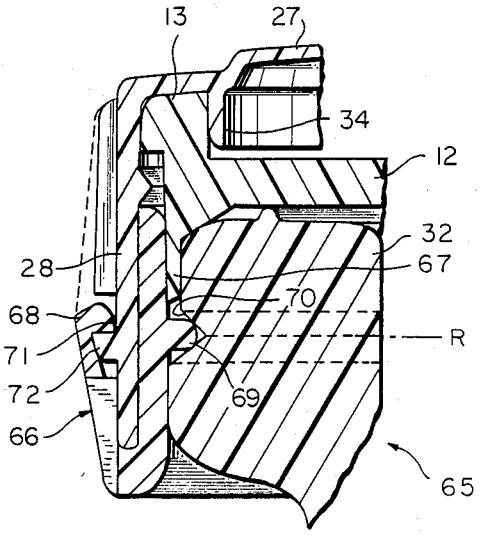

A second variation of the mechanical seal is indicated at 65 in FIG. 6. In this form of the invention, a retaining ring 66 has a first component 67 adapted to engage between the skirt 28 and the neck 32 of the container, and a second component 68 adapted to snap over the outer surface of the bottom edge of the skirt. A radially inwardly directed locking bead 69 on the inner surface of the first component snap engages in a groove 70 on the neck 32 of the container, while complemental locking beads 71 and 72 on the second component and on the skirt, respectively, interengage to secure the parts in assembled relationship.

Figure 7:
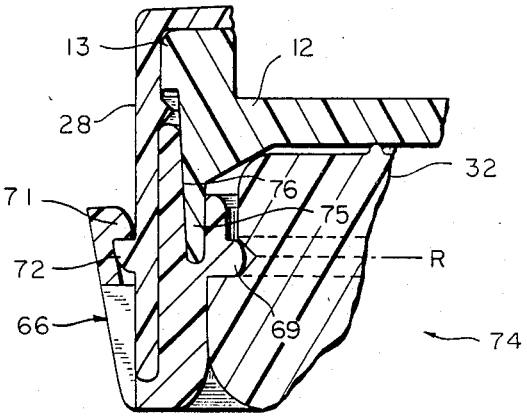

FIG. 7 shows a third variation 74, which is similar to the second variation, except that a depending flange 75 on the outer margin of the main cylinder housing and poppet retainer is received in an annular pocket 76 formed in the retaining ring.

Figure 8:
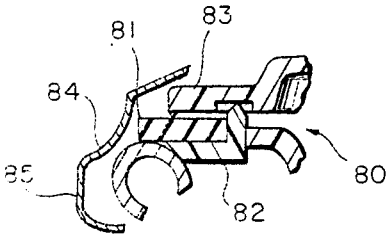

In FIG. 8, a suitable mechanical seal for holding the valve assembly to a metal can finish is indicated at 80. In this form of the invention, a separate sealing gasket 81 is interposed between outer peripheral edge portions 82 and 83 of the main cylinder housing and poppet retainer and the flexible valve housing, respectively, and a metal ferrule 84 has an outer edge portion 85 deformed over the components and the neck finish of the can to hold the parts together.

Figure 9:
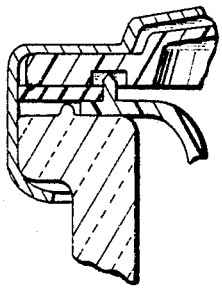

FIG. 9 shows a variation of the form of invention illustrated in FIG. 8, in that the metal ferrule and gasket seal for the housing and seat member are attached to a plastic or glass bottle rather than to a metal can.

Figure 10:
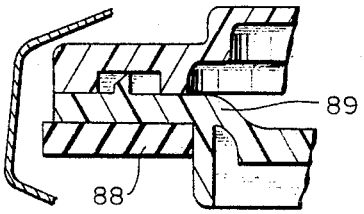

A still further variation is indicated at 87 in FIG. 10, wherein the gasket 88 lies under an outwardly projecting flange 89 on the main cylinder housing. This form of seal could be adapted to either of the container constructions shown in FIGS. 8 and 9.

Another form of the invention is shown at 90 in FIG. 11. This form differs from that shown in FIG. 1 in that the poppet member is of two piece construction, including a first part 91 formed by valve head 92 and depending shaft 93 with snap engagement means 94 on the lower end thereof, and a second part 95 formed by piston unit 96. The piston unit 96 has detent means 97 in an upper portion thereof for complemental engagement with the detent means 94 on the lower nd of the shaft 93, whereby the two parts may e snapped together after the shaft is inserted downwardly through the area bounded by the seat 24. Further, a second valve sealing area 98 is defined by tat portion of the shaft 93 immediately below the valve head 92, and depending cylindrical skirt 99 has an inturned lip 100 thereon for sliding engagement with the area 98. Consequently, a double seal is effected by the valve, and flow can occur only after the head 92 is unseated from its sat 24 and the lip 100 is in registry with the grooved area 101 on the shaft 93. In all other respects, this form of the invention functions the same as that shown in FIG. 1.

A variation of the two- part poppet construction is shown at 105 in FIG. 13. In this form of the invention, the poppet valve 106 comprises a one-piece stem 107 having a reduced diameter portion 108 between its ends with opposed shoulders 109 and 110 on opposite sides thereof. The piston member 111 has central opening 112 therethrough, in which the reduced diameter portion 108 of the stem is tightly received. The piston is held securely in place on the stem by the opposed shoulders 109 and 110 engaged on opposite sides of the top or end wall of the piston. As shown in this figure, the valve 105 does not utilize any coil springs to assist in its operation, relying instead, on the effect of the pressure of material being dispensed and the inherent bias of the diaphragm 27.

Figure 14:
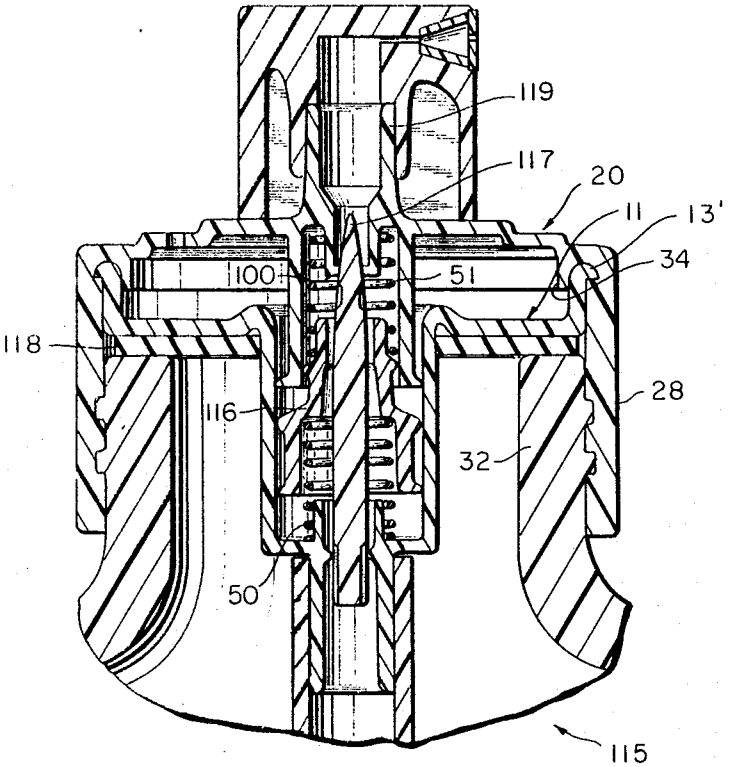
FIG. 14 is a fragmentary vertical sectional view, on a somewhat reduced scale, of a third modification of the invention.

A further modification of the invention is shown at 115 in FIG. 14. This form of the invention is similar to that shown in FIG. 1, except that the poppet valve 116 does not have an enlarged valve head thereon. Instead, the valve head comprises a tapered sealing portion 117 which extends through tee seat defined by sealing lip 100. Two springs 50 and 51 are used to urge the poppet in its opposite directions of movement, and there are no detents on the tail piece for cooperation with the sealing bead 19. In addition, a gasket 118 is interposed between the housing 11 and the neck 32 of the container. It will also be noted that the stem in this form of the invention actually comprises a cylindrical extension 119 for attachment of the actuator. This form of the invention is easier to mold and has a greater range of travel than the forms previously described.

Figure 15:
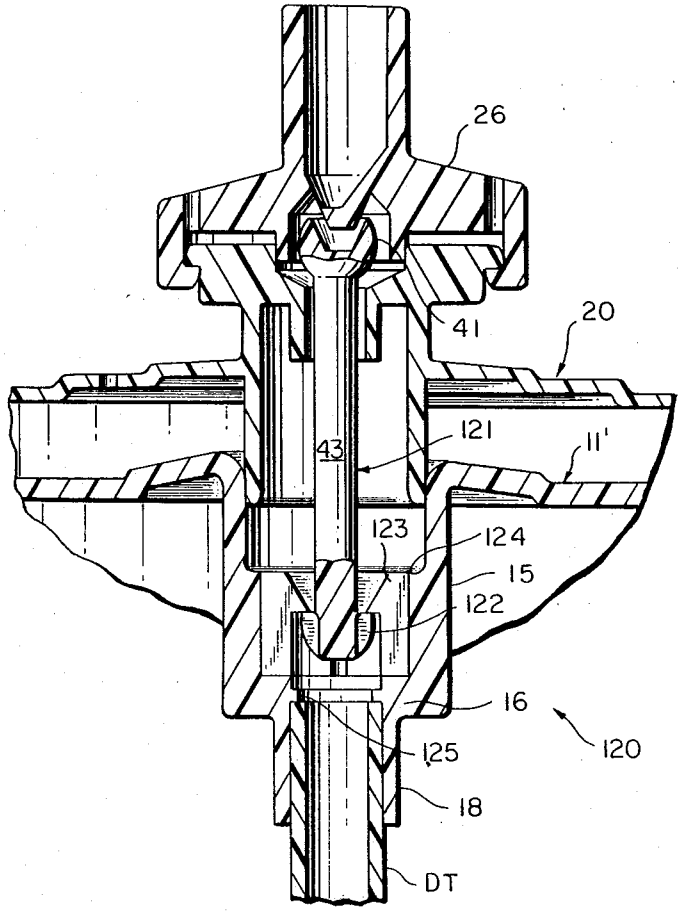
FIG. 15 is a fragmentary vertical sectional view of an aerosol valve in accordance with the invention.

The form of the invention indicated generally at 120 in FIG. 15 comprises an aerosol valve, and illustrates the interchangeability of the valve components between the pump and aerosol valve. For instance, the stem 26 and flexible valve housing 20 may be identical to those shown in connection with FIG. 1. The poppet member 121 has the same valve head 41 and shaft 43, except that the shaft is longer and terminates at its lower end in outwardly directed detents 122 rather than the piston arrangement of FIG. 1.

Additionally, the cylindrical valve housing and poppet retainer 11' is modified to include detents 123 for cooperation with the detents 122 on the poppet to limit upward movement of the poppet. A reduced diameter shoulder 124 is formed approximately mid way along the length of the wall 15, and a stop ring 125 is formed in the opening through bottom wall 66 to limit downward movement of the poppet. Further, the dip tube DT is received inside the extension 18 rather than over it as in FIG. 1, although either arrangement could be used.

Thus, with only relatively minor modifications to the poppet member and to the cylindrical valve housing and poppet retainer, the invention can be adapted for use either in the pump of FIG. 1 or the aerosol device of FIG. 15. All of the other components of the valve for use in either environment can be standardized for manufacture, inventory, assembly and use with either type of dispenser.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A valve having interchangeable components to make the valve usable in either a manually operated pump or an aerosol dispenser for dispensing material from containers, comprising:

an interchangeable main cylinder housing and poppet retainer with an end wall adapted to overlie an open end of a container, and having a peripheral edge portion with fastening means thereon to secure the housing to the container, a central portion of said end wall including a depending cylindrical wall defining a cylindrical recess therein and having an extension on a bottom end thereof for attachment of a dip tube;

a flexible valve housing and seat member usable in either a manually operated pump dispenser or an aerosol dispenser and having a cylindrical body with an upper end and a lower end, the upper end having a valve seat formed therein, said cylindrical body and said recess defining a valve space, a diaphragm-like wall extending radially outwardly from the body between the ends thereof and adapted to lie in spaced relation over the end wall of the cylinder housing, fastening means on an outer marginal edge of said diaphragm-like wall for securing the flexible housing in assembled relationship with the cylinder housing and a container; and an interchangeable valve poppet member for reciprocation in the valve space, said poppet member having a valve head on an upper end thereof for opening and closing movement relative to said valve seat, and a tail piece extending from said head downwardly through said valve space into proximity with the bottom end of said cylinder housing, said diaphragm-like wall having a residual bias urging the seat upwardly into contact with the valve head to close the valve, and said valve body and seat member being movable downwardly away from the valve head to open the valve.

2. A valve as claimed in claim 1, wherein:

said flexible valve housing and seat member cylindrical body has a stem attaching means on the upper end thereof; and a stem usable in either a manually operated pump dispenser or an aerosol dispenser secured on said stem attaching means on the upper end of said body, whereby downward movement of said stem causes downward movement of the valve seat away from the valve head to open the valve.

3. A valve as claimed in claim 1, wherein:

said poppet member tail piece has retaining means on a lower end thereof; and said cylinder housing has complemental retaining means engageable with the retaining means on the poppet member to limit axial movement of the poppet member, said valve comprising an aerosol dispenser.

4. A valve as claimed in claim 1, wherein:

said stem, said cylinder housing, said flexible valve housing and said container are snapped together.

5. A valve as claimed in claim 1, wherein:

said fastening means comprises nap-fitting detents.

6. A valve as claimed in claim 1, wherein:

piston means is formed on said poppet member tail piece, said piston means being slidable in the cylindrical recess of said cylinder housing and defining therewith a pump chamber, whereby said valve comprises a pump dispenser.

7. A valve as claimed in claim 6, wherein:

said tail piece is formed in two parts at a juncture between the head and the piston means, said parts having fastening means thereon for attaching the parts together.

8. A valve as claimed in claim 7, wherein:

a depending skirt is formed on said flexible valve housing in depending relation from said valve seat, and a radially inturned sealing lip is formed on the lower end of the skirt; and said poppet member tail piece has sealing area thereon extending downwardly from the valve head for cooperation with the lip, defining a double sealing area between the poppet member and the flexible valve housing.

9. A valve as claimed in claim 6, wherein:

spring means is engaged between said cylinder housing and the poppet member for urging the poppet member upwardly in a direction to expand the pump chamber.

10. A valve as claimed in claim 9, wherein:

a second spring is engaged between said poppet and the flexible valve housing and seat member, urging the poppet downwardly in a direction to decrease the volume of the pump chamber.

11. A valve as claimed in claim 6, wherein:

passage means extends upwardly through the piston means for conveying material from the pump chamber to the valve space.

12. A valve as claimed in claim 11, wherein:

the tail piece projects downwardly below the piston means; and said cylinder housing has a guide opening formed therein in which said tail piece is slidably received.

13. A valve as claimed in claim 12, wherein:

the lower end of the body is slidably received in the cylindrical recess of said cylinder housing.

14. A valve as claimed in claim 6, wherein:

the valve head comprises an elongate sealing area on an upper end portion of said poppet valve; and said valve seat comprises a flexible lip slidable on said sealing area.

15. A valve as claimed in claim 14, wherein:

a spring means is engaged between said poppet valve and said flexible valve housing and seat member, urging the poppet valve downwardly so that the piston decreases the volume of the pump chamber to pressurize material therein.

16. A valve as claimed in claim 15, wherein:

a second spring means is engaged between the poppet valve and the cylindrical housing and poppet retainer, urging the poppet valve upwardly so that the piston enlarges the volume of the pump chamber.

17. A valve as claimed in claim 1, wherein:

said poppet comprises a one-piece tail piece having a reduced diameter portion between the ends thereof, with retaining shoulders on opposite sides of said reduced diameter portion; and a separate piston member has a central opening in which said reduced diameter portion is received, said shoulders engaging on opposite sides of said piston member to retain the piston member in position on said tail piece.

18. A valve as claimed in claim 17, wherein:

poppet retaining means are formed on a lower end portion of said tail piece; and complemental poppet retaining means are formed in said cylindrical recess in said depending cylindrical wall of said cylinder housing, for retaining said poppet in operative relationship with said cylinder housing converted to use either in a manually operated pump dispenser or an aerosol dispenser.

19. In a dispensing valve for dispensing product from a container, said dispensing valve having attaching means for securing the valve to a neck of the container and including a valve housing with means defining a valve seat, a poppet valve reciprocable in said housing for movement relative to said valve seat, and a cylinder housing and poppet retainer for guiding and limiting movement of said poppet, the improvement comprising:

radially enlarged flanges on said valve housing and cylinder housing extending in stacked relationship to one another in overlying juxtaposition to the neck of the container; and said attaching means including complemental snap detent mans on said flanges for securing the valve housing and cylinder housing together, and one of said flange having depending skirt means with snap detent means thereon for engagement with complemental snap detent means on said container neck to hold the valve to the container.

20. In a dispensing valve for dispensing product from a container, said dispensing valve having attaching means for securing the valve to a neck of the container and including a valve housing with means defining a valve seat, a poppet valve reciprocable in said housing for movement relative to said valve seat, and a cylinder housing and poppet retainer for guiding and limiting movement of said poppet, the improvement comprising:

radially enlarged flanges on said valve housing and cylinder housing extending in stacked relationship in overlying relationship to one another and in verlying juxtaposition to the neck of the container, said flanges having interfitting projection and recess means for aligning and retaining the flanges in position relative to one another and defining a space between at least a portion of the flanges;

sealing gasket means received in said space in clamped relationship between said flanges and extending radially outwardly beyond at least the underlying flange and disposed in overlying, contacting relationship with an end surface of said container neck; and a retaining ferrule engaged over the topmost flange and wrapped around the outer periphery of said flanges and said gasket and having a portion engaged with the neck of the container to hold the valve to the container neck.

* * * * *